US009045964B2

(12) United States Patent
Valenzuela

(10) Patent No.: US 9,045,964 B2
(45) Date of Patent: Jun. 2, 2015

(54) APPARATUS, METHODS, AND SYSTEMS FOR FILLING AND CIRCULATING FLUID IN TUBULAR MEMBERS

(76) Inventor: Geyel Valenzuela, Henderson, TX (US)

( * ) Notice: Subject to any disclaimer, the term of this patent is extended or adjusted under 35 U.S.C. 154(b) by 271 days.

(21) Appl. No.: 13/573,328

(22) Filed: Sep. 11, 2012

(65) Prior Publication Data

US 2014/0069660 A1 Mar. 13, 2014

(51) Int. Cl.
*E21B 33/126* (2006.01)
*E21B 19/16* (2006.01)
*E21B 21/10* (2006.01)

(52) U.S. Cl.
CPC ..... *E21B 33/126* (2013.01); *E21B 19/16* (2013.01); *E21B 21/10* (2013.01)

(58) Field of Classification Search
CPC ..... E21B 33/126; E21B 21/10; E21B 19/16; E21B 19/00; E21B 21/00; E21B 33/02; E21B 23/00; E21B 19/10; E21B 33/129
USPC ..... 166/376, 377, 382, 387, 215, 77.53, 166/379, 90.1, 202, 191, 180
See application file for complete search history.

(56) References Cited

U.S. PATENT DOCUMENTS

| | | | | |
|---|---|---|---|---|
| 4,129,308 | A | 12/1978 | Hutchinson | |
| 4,765,405 | A | 8/1988 | Clark | |
| 5,918,673 | A | 7/1999 | Hawkins et al. | |
| 6,173,777 | B1 | 1/2001 | Mullins | |
| 7,552,769 | B2 | 6/2009 | Cherewyk | |
| 2010/0319936 | A1 * | 12/2010 | Alff et al. | 166/385 |

* cited by examiner

*Primary Examiner* — Yong-Suk (Philip) Ro

(57) ABSTRACT

A fill up and circulation tool having an elongate body with an insertion section adapted for insertion into a tubular member, a base section adapted for engagement with a top drive, and a gauge section having a diameter less than that of the base section. A packer cup assembly and at least one spacer can be adjustably associated with the gauge section, the packer cup assembly being positionable at a plurality of locations along the gauge section by placing the packer cup assembly and one or more spacers relative to one another in a desired configuration, such that the packer cup assembly and one or more spacers occupy substantially all of the gauge section. The spacing and configuration of the packer cup assembly along the gauge section can be selected depending on the dimensions or type of top drive, elevator, bails, or other equipment at a worksite.

19 Claims, 4 Drawing Sheets

APPARATUS, METHODS, AND SYSTEMS FOR FILLING AND CIRCULATING FLUID IN TUBULAR MEMBERS

FIELD

Embodiments usable within the scope of the present disclosure relate, generally, to apparatus, methods, and systems usable for filling and circulating fluid in tubular members, and more specifically, to fill up and circulation tools and related methods and systems for adapting such tools for use at a worksite.

BACKGROUND

Conventionally, when connecting joints of a tubular string (e.g., casing and/or drillpipe) and lowering the tubular string into a wellbore, a fill up and circulation tool is used to fill each tubular joint with fluid and to enable circulation of fluid through the string. Such tools typically include a box end or similar means of connection for engagement with a top drive, while the opposing end is tapered and/or otherwise configured for insertion into a tubular joint that is gripped by an elevator. Along the body of the tool is a packer cup or similar sealing member.

When it is desired to circulate fluid through the tubular string, the fill up and circulation tool must be lowered from a raised/upper position (e.g., a fill up mode) to a lowered position where the packer cup seals the upper end of the tubular string (e.g., a circulation mode). Because this action must be performed numerous, successive times when engaging and lowering tubular joints into a wellbore, it is desirable to configure a fill up and circulation tool such that when the tool is in the raised/fill up position, the packer cup is positioned as close to the end of the tubular string as possible, without interfering with operation of the tool. This configuration minimizes the time required to insert the tool into the tubular string to form a seal using the packer cup, which results in improved efficiency and reduced cost, while also enabling a seal to be formed quickly in situations where fluid may otherwise spill from the upper end of the tubular string.

Configuring a fill up and circulation tool in this manner can be a time and labor-intensive undertaking, requiring special tools and actions to properly "dress" the tool. For each worksite, a tool must be assembled remotely, in a configuration determined by the type and/or dimensions of the top drive, elevator, and/or bails used, then transported to the worksite for use. When it becomes necessary to reconfigure the tool for use at the same or a different worksite, the tool must usually be transported to a remote location for reconfiguration. Often, configuring the tool to accommodate certain types and/or dimensions of top drives, elevators, or bails, requires modifying the overall length of the tool.

Due to the variation that exists among tubular sizes and/or diameter, a multitude of fill up and circulation tools exist, each corresponding to a given, generally narrow range of diameters. Thus, selection of an appropriate tool that can be configured in a suitable manner is also of great importance. In tubular joints and/or strings having regions of varying diameter (e.g., tapered portions), it is often beneficial to use fill up and circulation tools that include multiple packer cups, each having a different diameter intended to engage a differing portion of the tapered region of a tubular member.

A need exists for fill up and circulation tools that can be configured and reconfigured, as needed, on site, without requiring special tools, skills, or time consuming operations.

A need also exists for fill up and circulation tools that can accommodate a wider range of tubular diameters than conventional tools.

A further need exists for fill up and circulation tools that can be configured and reconfigured without modifying the overall length of the tools.

Embodiments usable within the scope of the present disclosure meet these needs.

SUMMARY

Embodiments usable within the scope of the present disclosure include fill up and circulation tools that include an elongate bod, having an insertion section adapted for insertion into a tubular member (e.g., a joint of drill pipe or casing), a gauge section having a first diameter, and a base section having a second diameter greater that the first, the base section being adapted for engagement with a top drive and/or other type of drive mechanism (e.g., through use of a box or pin connector and/or a similar type of threaded connection). In various embodiments, the insertion section of the tool can include a mud saver sub and/or a flex hose, and/or the base section can include a pin saver sub associated therewith.

A packer cup assembly (e.g., a thimble, gauge ring, and packer cup) and at least one spacer can be adjustably associated with the gauge section of the body, such that the packer cup can be positioned at a plurality of locations along the gauge section, e.g., depending on the configuration determined to most optimally correspond to a worksite. For example, the packer cup assembly can be provide at an end of the gauge section, while at least one spacer can be provided adjacent to the packer cup assembly, such that the packer cup assembly and the one or more spacers occupy substantially all of the gauge section, thereby securing the packer cup assembly proximate to the end of the gauge section. Alternatively, a first spacer can be provided at the end of the gauge section, the packer cup assembly can be provided adjacent to the first spacer, and a second spacer can be provided adjacent to the packer cup assembly at the opposing end thereof, such that the packer cup assembly, the first spacer, and the second spacer occupy substantially all of the gauge section, thereby securing the packer cup assembly along the middle of the gauge section. Embodiments of the fill up and circulation tools described herein can include packer cup assemblies configurable to engage tubular members having an inner diameter ranging from 7 inches to 13.375 inches, though it should be understood that tools able to accommodate tubular members having an inner diameter outside of this exemplary range can also be used without departing from the scope of the present disclosure.

In a preferred embodiment, the elongate body of the tool can include a unitary (e.g., one-piece) member, while the packer cup assembly and the one or more spacers can be adjustably associated it the body to enable positioning of the packer cup without requiring use of specialized tools, separation of the elongate body into multiple parts, and/or modification of the length of the body.

In further embodiments, the tool can include an additional packer cup assembly adjustably engageable with the gauge section, the additional packer cup assembly having a diameter that differs from the first packer cup assembly, such that the tool can be configured to engage a tapered region of a tubular member.

Embodiments usable within the scope of the present disclosure further include methods for adapting a fill up and circulation tool for use at a worksite that include identifying one or more dimensions associated with a top drive, a bail, an elevator, or combinations thereof, and providing a unitary elongate body having a gauge section. A position on the gauge section that corresponds to the identified dimension(s) can be determined, and a packer cup can be provided to the position by installing one or more spacers and a packer cup assembly on the gauge section, such that the one or more spacers and the packer cup assembly occupy substantially all of the gauge section.

Embodiments usable within the scope of the present disclosure further include systems for adapting a fill up and circulation tool for use at a worksite that include an elongate body having a first end adapted for engaging a drive mechanism, a second end adapted for insertion into a tubular member, and a gauge section between the first and second ends, having a diameter less than that of the first and second ends. The system can further include a packer cup assembly and a plurality of spacers adapted for engagement and adjustable positioning at a plurality of locations on the gauge section.

In an exemplary embodiment, the system can include a first spacer having a first length, a second spacer having a second length greater than the first, and a third spacer having a third length greater than the second. In such an embodiment, the third spacer could be provided on either end of the gauge section, while the packer cup assembly is provided on the opposing end of the gauge section, such that the third spacer and packer cup assembly occupy substantially all of the gauge section, thereby securing the packer at the end of the gauge section. Alternatively, the first and second spacers can be provided at opposing ends of the gauge section, while the packer cup assembly is installed between the first and second spacers, such that the first and second spacers and the packer cup assembly occupy substantially all of the gauge section, thereby securing the packer along the middle of the gauge section at a desired position.

By way of example, an embodiment of a fill up and circulation tool could include a gauge section having a length of 4.0 feet, a packer cup assembly having a length of 1.0 foot, and three spacers: a first having a length of 1.0 foot, a second having a length of 2.0 feet, and third having a length of 3.0 feet. In this exemplary embodiment, through selective positioning of one or more of the spacers and packer cup assembly along the gauge section, the packer cup assembly could be adjustably placed at four different positions along the gauge section, depending on the characteristics of the worksite and equipment used. It should be readily understood that various numbers and/or sizes of components could be used to configure a fill up and circulation tool, as needed, without departing from the scope of the present disclosure.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
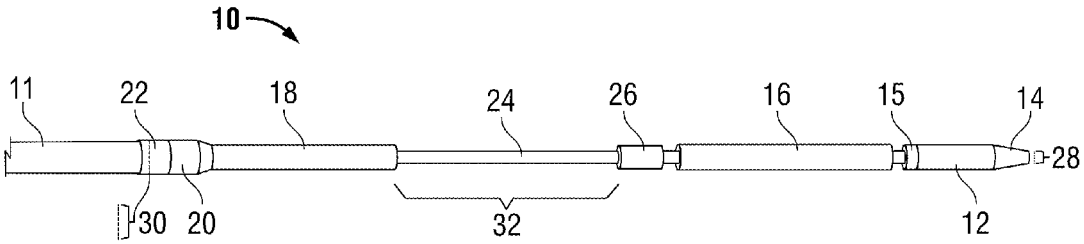
FIG. 1 depicts a side view of an embodiment of a fill up and circulation tool usable within the scope of the present disclosure.

Referring now to FIG. 1, a diagrammatic side view of an embodiment of a fill up and circulation tool (10) usable within the scope of the present disclosure is shown. The depicted tool (10) is shown having generally elongate body (e.g., a tubular and/or cylindrical member) that includes an insertion section at one end thereof, which is shown including a mud saver sub (12) with a tapered end (14) adapted for insertion into tubular joints during operations (e.g., to fill tubular joints and/or a string with fluid and/or to circulate fluid through a string). A thread locked collar (15) or similar means (e.g., a threaded connection, fasteners, a force/interference fit, welding, adhesives, sealing members) can be used to secure the mud saver sub (12) to the remainder of the tool (10). A flex hose (16) is shown proximate to the mud saver sub (12) for communicating fluid between the tool (10) and a tubular joint. In an embodiment, the flex hose (16) can be adapted to operate at 7,000-10,000 pounds of pressure, or more. In a further embodiment, the flex hose (16) can be provided with a single valve (e.g., a spring loaded fluid valve and housing) at an end thereof (e.g., at the bottom end, proximate to the mud saver sub (12)), such that the flex hose (16) and remainder of the tool (10) can accommodate tubular members (e.g., casing) having an inner diameter ranging from 7 inches to 13.375 inches, without requiring reconfiguration. The valve can be configured for easy removal from and placement within the housing, such that a user can maintain, lubricate, and/or replace portions of the valve (e.g., O-rings and/or similar sealing members) at any location, and can be reused for multiple operations before requiring such maintenance and/or replacement of parts. In an embodiment, the valve can be adapted to require approximately 80 pounds of pressure to open the valve to permit flow of drilling fluids, while also being adaptable to accept flow from the casing during flow back operations, requiring zero pressure to open.

The tool (10) is further shown having a base section (18) at the opposing end thereof, configured for engagement with a top drive or similar drive mechanism (11). Specifically, the base section (18) is shown having a first cylindrical and/or tubular portion with a first diameter (e.g., an outer diameter of 5.25 inches), that tapers outward toward the end of the tool (10) to a connecting region (20) having a larger diameter (e.g., an outer diameter of 6.625 inches). The connecting region (20) can include threads (e.g., a threaded box or pin connection) for direct engagement with a top drive (11); however, the depicted embodiment includes a pin saver sub (22), adapted for engagement to the tool (10) and to a top drive or similar drive mechanism (11), usable to reduce wear on the tool (10) body, itself, that can be caused by repeatedly engaging and disengaging the tool (10) from a top drive (11) (e.g., when reusing the tool (10) for various operations). Use of the pin saver sub (22) causes the majority of wear generated by repeated engagement and disengagement between the tool (10) and a drive mechanism (11) to be borne by the pin saver sub (22), rather than the body of the tool (10), itself, which preserves the tool connection (e.g., a 4.5 I.F. connection), while enabling easy replacement of the pin saver sub (22) when necessary.

A gauge section (24) (e.g., a mandrel), having a thread locked collar (26) proximate to an end thereof, is shown between the insertion and base sections of the tool (10). As described above, the gauge section has a diameter (28, indicated by bracket and dotted line) (e.g., an outer diameter of 3.5 inches), less than the diameter (30, indicated by bracket and dotted lines) of the base section (18) (e.g., an outer diameter of 5.25 inches). Additionally, the gauge section (28) is provided with a length (32) (e.g., 4 to 4.5 feet) along which one or multiple packer cup assemblies and one or more spacers can be positioned. Due to the ability to install packer cup assemblies and spacers along the gauge section (28) without requiring disassembly and/or modification of the body of the tool (10), as described above, the overall length of the tool body can remain constant. For example, in an embodiment, excluding the pin saver sub (22), flex hose (16), and mud saver sub (12), the remainder of the tool (10) (e.g., the base section (18) and the gauge section (24)) can have a constant length of 8.5 feet. In a preferred embodiment, the gauge section (24) can have a length (32) of 4.5 feet, while the base section (18) has a length of 4.0 feet.

Figure 2:
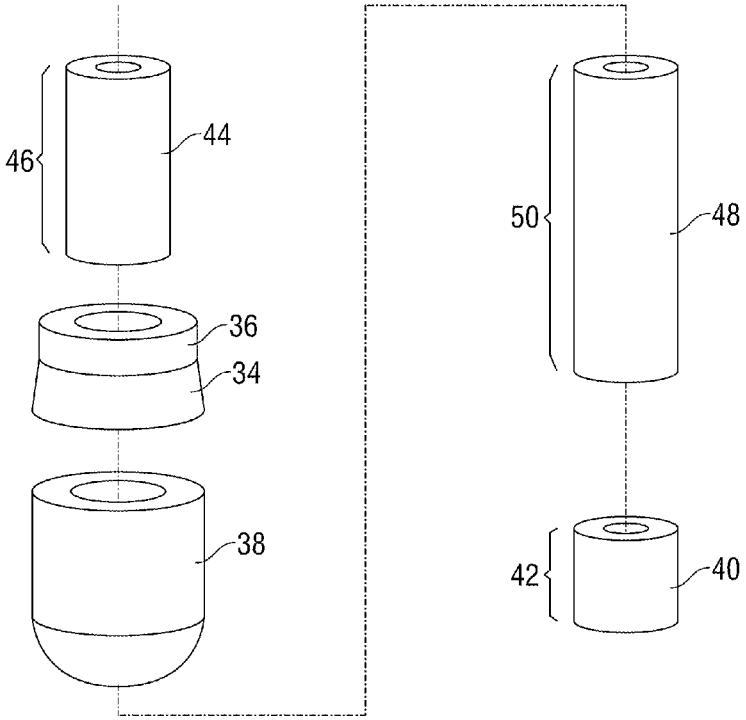
FIG. 2 depicts isometric views of a packer cup assembly and spacers usable within the fill up and circulation tool of FIG. 1.

Referring now to FIG. 2, diagrammatic isometric views of a packer cup assembly (34, 36, 38) and spacers (40, 44, 48), usable to configure embodiments of the present fill up and circulation tool (e.g., tool (10), shown in FIG. 1), are depicted. Specifically, as described above, the packer cup assembly (34, 36, 38) and one or more of the spacers (40, 44, 48) can be positioned along the gauge section (24, shown in FIG. 1) of the tool (10, shown in FIG. 1), such that the packer cup (34) is closely positioned to the upper end of a tubular string. The optimal position of the packer cup (34) along the gauge section can be determined using the type and/or dimensions of the top drive, elevator, bails, and/or other features of the worksite.

The packer cup assembly is shown including a packer cup (34), which can include any manner of sealing element able to seal across the inner diameter of a tubular joint, and in an embodiment, can include one or more interchangeable sealing elements configured to engage joints of casing having inner diameters ranging from 7 inches to 13.375 inches. The packer cup (34) is shown adjacent to a thimble (36), and is further shown having a gauge ring (38) positioned on the opposing end thereof.

FIG. 2 also shows three spacers (40, 44, 48), each having a generally tubular (e.g., cylindrical) shape, with an axial bore therein for accommodating passage of the gauge section (24, shown in FIG. 1) of the tool. The first spacer (40) is depicted having a first length (42) (e.g., one foot), the second spacer (44) is depicted having a second length (46) (e.g., two feet) greater than the first length (42), and the third spacer (48) is depicted having a third length (50) (e.g., three feet) greater than the second length (46). In use, the packer cup assembly (34, 36, 38) and one or more of the spacers (40, 44, 48) can be installed on the gauge section of the tool, such that individual spacers used and the packer cup assembly occupy substantially all of the gauge section. In this manner, the position of the packer cup (34) along the gauge section is fixed, e.g., the packer cup (34) is prevented from axial movement along the gauge section due to abutment between the thimble (36) and/or the gauge ring (38) and adjacent spacers, and/or the adjacent base section (18, shown in FIG. 1) or collar (26, shown in FIG. 1).

For example, FIGS. 3A through 3I show various configurations of a fill up and circulation tool in which a packer cup assembly (P) is positioned along the gauge section (24) of the tool, between the base section (18) and a collar (26) and/or similar shoulder or other feature having a diameter greater than that of the gauge section (24). In operation, the packer cup assembly (P) and one or more spacers can be placed over the gauge section (24), such that the gauge section (24) mandrel passes through the bores of each spacer and of each element of the packer cup assembly, then the collar (26) or similar member can be installed thereon and tightened into abutment and/or compression with the spacers and packer cup assembly.

Figure 3A:
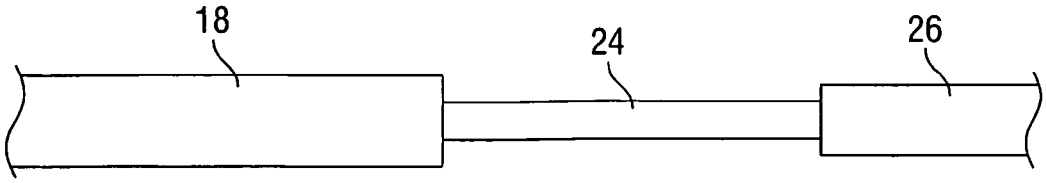
FIGS. 3A through 3J depict diagrammatic side views showing various configurations of a packer cup assembly and spacers in conjunction with an embodiment of a fill up and circulation tool usable within the scope of the present disclosure.

FIG. 3A depicts the tool with the packer cup assembly and spacers removed, such that the gauge section (24) is visible between the base section (18) and collar (26).

Figure 3B:
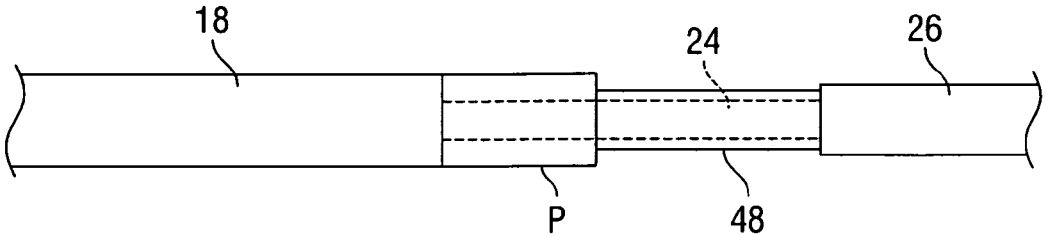

FIG. 3B depicts the tool having the packer cup assembly (P) installed proximate to and abutting the base section (18), while a single spacer (48) (e.g., the third spacer, shown in FIG. 2) is installed adjacent to the packer cup assembly (P), abutting the collar (26), such that the spacer (48) and packer cup assembly (P) occupy substantially the entire length of the gauge section (24) extending between the base section (18) and the collar (26).

Figure 3C:
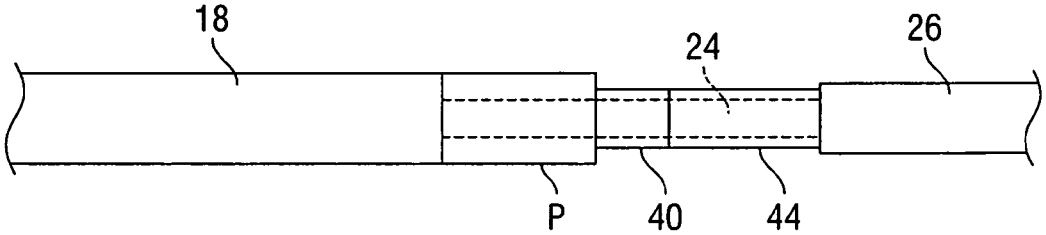
Figure 3D:
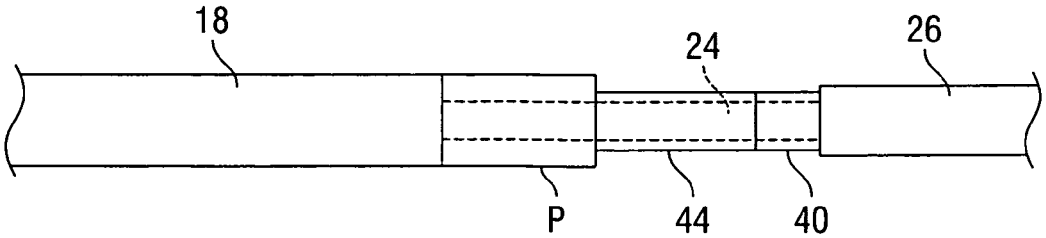

FIG. 3C depicts an alternate configuration of the tool shown in FIG. 3B, in which the single spacer (48) has been replaced with a first spacer (40) having a first length (e.g., the first spacer, shown in FIG. 2), and a second spacer (44) having a second length (e.g., the second spacer, shown in FIG. 2), while the packer cup assembly (P) remains positioned adjacent to the base section (18). Similarly, FIG. 3D depicts an alternate configuration of the tool shown FIG. 3C, in which the positions of the first and second spacers (40, 44) have been interchanged, while the packer cup assembly (P) remains positioned adjacent to the base section (18). It should be readily understood from the depicted and described embodiments that any number and arrangement of spacers could be used in place of the single spacer (48), shown in FIG. 3B, and the first and second spacers (40, 44), shown in FIGS. 3C and 3D, without departing from the scope of the present disclosure.

Figure 3E:
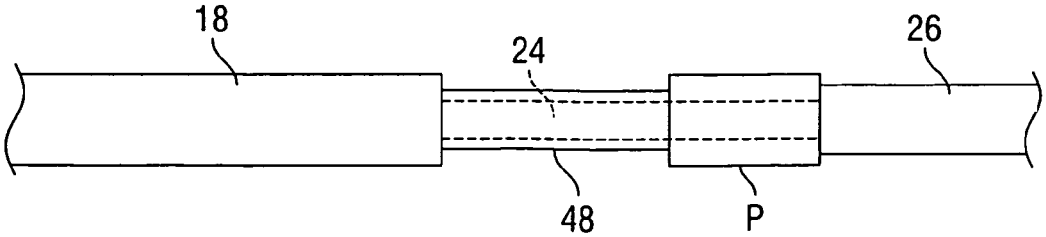
Figure 3F:
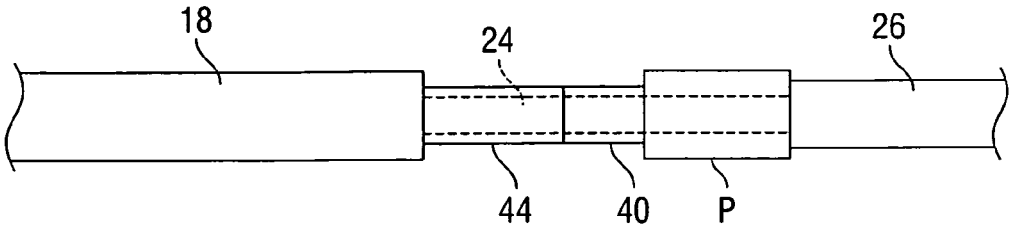
Figure 3G:
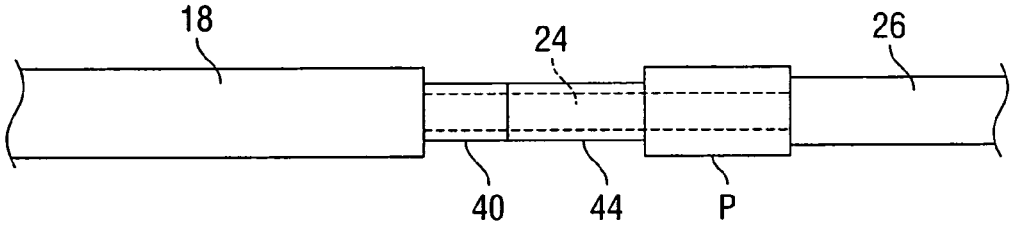

FIG. 3E depicts the tool having the packer cup assembly (P) installed proximate to and abutting the collar (26), while a single spacer (48) (e.g., the third spacer, shown in FIG. 2) is installed adjacent to and abutting the base section (18) and packer cup assembly (P). FIG. 3F depicts an alternate configuration of the tool shown in FIG. 3E, in which the single spacer (48) has been replaced with a first spacer (40) having a first length (e.g., the first spacer, shown in FIG. 2), and a second spacer (44) having a second length (e.g., the second spacer, shown in FIG. 2), while the packer cup assembly (P) remains positioned adjacent to the collar (26). Similarly, FIG. 3G depicts an alternate configuration of the tool shown in FIG. 3F, in which the positions of the first and second spacers (40, 44) have been interchanged, while the packer cup assembly (P) remains positioned adjacent to the collar (26).

Figure 3H:
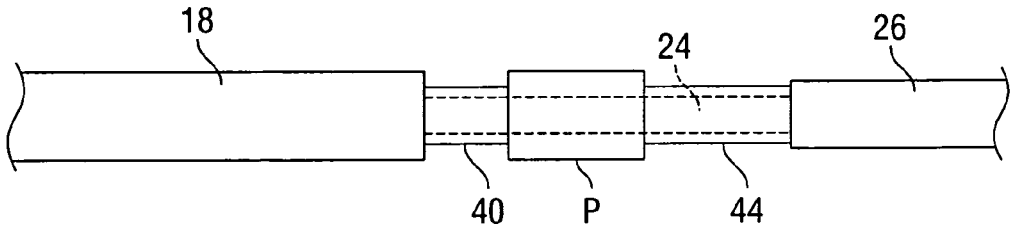

FIG. 3H depicts the tool having the packer cup assembly (P) installed along the middle portion of the gauge section (24), approximately two thirds the distance from the collar (26) to the base section (18). A first spacer (40) having a generally short length, is positioned adjacent to and abutting the base section (18) and a first end of the packer cup assembly (P), while a second spacer (44) having a greater length (e.g., about twice the length of the first spacer (40)) is shown adjacent to and abutting the collar (26) and the opposing end of the packer cup assembly (P).

Figure 3I:
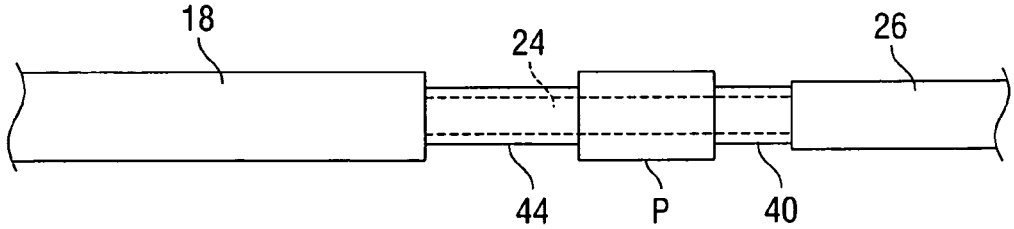

FIG. 3I depicts the tool having the packer cup assembly (P) installed along the middle portion of the gauge section (24), approximately two thirds the distance from the base section (18) to the collar (26). A first spacer (40) having a generally short length, is positioned adjacent to and abutting the collar (26) and a first end of the packer cup assembly (P), while a second spacer (44) having a greater length (e.g., about twice the length of the first spacer (40)) is shown adjacent to and abutting the base section (18) and the opposing end of the packer cup assembly (P).

It should be understood from the configurations shown in FIGS. 3H and 3I, the other configurations shown (FIGS. 3A through 3G), and the above disclosure that each of the embodiments depicted and described above are exemplary and non-limiting, and that any number of spacing elements can be used to position a packer cup at any desired position along the gauge section of a fill up and circulation tool using the systems and methods described herein. As such, any number of spacers, including zero, can be positioned on either or both sides of a packer cup assembly, and each spacer can have any desired length to appropriately space the packer cup assembly at a desired position. As described previously, the optimal position of a packer cup along the gauge section of a tool can be determined based on the type and/or dimensions of the top drive, elevator, and/or bails used at a worksite, and/or other dimensions or features of other equipment. The systems and methods described above enable a packer cup assembly to be positioned and repositioned, as needed, for use at one or multiple worksites, on-site or at any desired location, without requiring specialized tools. Generally, the collar (26) and/or another portion of the tool can be removed from the gauge section (24) to allow access to the mandrel thereof, then any combination of spacers and packer cup elements (e.g., gauge ring, thimble, packer cup) can be slid on to the mandrel of the gauge section (24) and secured thereto (e.g., by securing the collar (26) to the gauge section (24)), such that the spacers retain the packer cup in a desired position.

Figure 3J:
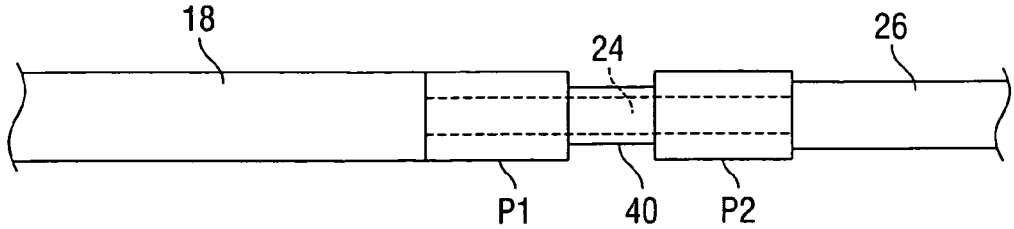

Additionally, the length of the gauge section (24) enables multiple packer cup assemblies to be installed thereon. For example, FIG. 3J depicts a configuration in which a first packer cup assembly (P1) is installed proximate to the base section (18), a second packer cup assembly (P2) is installed proximate to the collar (26), and a single spacer (40) is positioned between the packer cup assemblies (P1, P2). The second packer cup assembly (P2) is shown having a diameter smaller than that of the first packer cup assembly (P1), such that in combination, the packer cup assemblies (P1, P2) can be used to engage the inner diameter of a tubular member having a tapered region.

Figure 4:
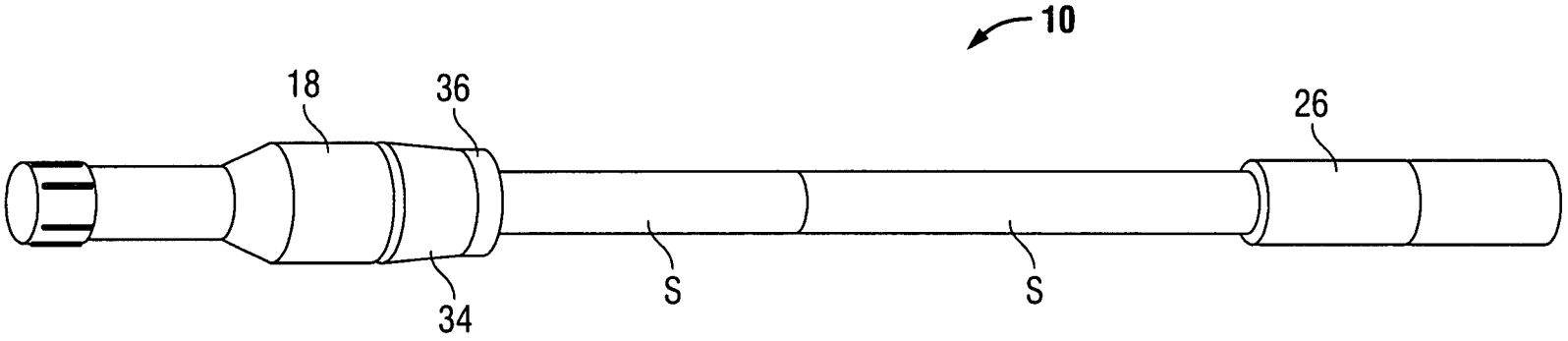
FIG. 4 depicts a side view of an embodiment of a fill up and circulation tool usable within the scope of the present disclosure.

Referring now to FIG. 4, an alternate embodiment of a fill up and circulation tool (10) usable within the scope of the present disclosure is shown, the tool (10) including an elongate body with a base section (18) adapted for engaging a drive mechanism at a first end thereof, and a collar (26) or similar member at the opposing end thereof. A packer cup (34) and thimble (36) are shown secured along a gauge section of the tool (10), with two spacers (S) secured adjacent to the packer cup (34) and thimble (36), such that the spacers (S) and packer cup assembly occupy substantially all of the gauge section of the tool (10). As described previously, the tool (10) can further engage a flex hose, mud saver sub, and/or other similar components.

Embodiments usable within the scope of the present disclosure thereby provide fill up and circulation tools that can be configured, and reconfigured, as needed, on site, depending on the dimensions of various pieces of equipment and/or other factors at a worksite, without requiring special tools, skills, or time consuming operations, the tool having a generally constant length that remains unchanged despite how the tool is dressed and/or configured. Preferred embodiments can be adapted to accommodate casing joints having an inner diameter ranging from 7.0 to 13.375 inches.

While various embodiments usable within the scope of the present disclosure have been described with emphasis, it should be understood that within the scope of the appended claims, the present invention can be practiced other than as specifically described herein.

What is claimed is:

1. A fill up and circulation tool comprising:

an elongate body having an insertion section adapted for insertion into a tubular member, a gauge section having a first diameter, and a base section having a second diameter greater than the first diameter, wherein the base section is adapted for engagement with a top drive; and a packer cup assembly and at least one spacer adjustably associated with the gauge section, wherein the packer cup assembly is positionable at a plurality of locations along the gauge section by:

providing the packer cup assembly at an end of the gauge section and providing at least one spacer adjacent to the packer cup assembly such that the packer cup assembly and said at least one spacer occupy substantially all of the gauge section; or providing a first spacer at the end of the gauge section, providing the packer cup assembly adjacent to the first spacer such that a first end of the packer cup is adjacent to the first spacer, and providing a second spacer adjacent to a second end of the packer cup assembly, such that the packer cup assembly, the first spacer, and the second spacer occupy substantially all of the gauge section.

2. The fill up and circulation tool of claim 1, further comprising a mud saver sub and a flex hose associated with the insertion section.

3. The fill up and circulation tool of claim 1, further comprising a pin saver sub associated with the base section.

4. The fill up and circulation tool of claim 1, wherein the elongate body comprises a one-piece member, and wherein the packer cup assembly and said at least one spacer are adjustably associated with the one-piece member for enabling positioning of the packer cup assembly without use of specialized tools or separation of the elongate body.

5. The fill up and circulation tool of claim 1, wherein the gauge section comprises a total length, wherein said at least one spacer comprises a single spacer having a first length, wherein the packer cup assembly comprises a second length, and wherein the sum of the first length and the second length equals the total length.

6. The fill up and circulation tool of claim 1, wherein the gauge section comprises a total length, wherein the first spacer comprises a first length, wherein the second spacer comprises a second length, wherein the packer cup assembly comprises a third length, and wherein the sum of the first length, the second length, and the third length equals the total length.

7. The fill up and circulation tool of claim 1, wherein the packer cup assembly comprises a thimble, a gauge ring, and a packer cup.

8. The fill up and circulation tool of claim 1, wherein the packer cup assembly is configurable to engage tubular members having an inner diameter ranging from 7 inches to 13.375 inches.

9. The fill up and circulation tool of claim 1, further comprising an additional packer cup assembly adjustably engageable with the gauge section, wherein the additional packer cup assembly and the packer cup assembly have differing diameters adapted for engaging a tapered region of the tubular member.

10. A method for adapting a fill up and circulation tool for use at a worksite, the method comprising the steps of:

identifying a dimension associated with a drive mechanism for the fill up and circulation tool within a casing string;

providing a unitary elongate body having a gauge section, wherein the gauge section comprises a total length;

determining a position on the gauge section corresponding to the dimension; and providing a packer cup assembly comprising a first length at the position on the gauge section by installing at least one spacer comprising a second length and the packer cup assembly on the gauge section, such that said at least one spacer and the packer cup assembly occupy substantially all of the gauge section, and such that the sum of the first length and the second length equals the total length.

11. The method of claim 10, wherein the elongate body comprises a one-piece member, and wherein the packer cup assembly and said at least one spacer are adjustably associated with the one-piece member for enabling positioning of the packer cup assembly without use of specialized tools or separation of the elongate body, the method further comprising the step of repositioning the packer cup assembly and said at least one spacer on the gauge section.

12. The method of claim 10, wherein the gauge section comprises a total length, wherein said at least one spacer comprises a first spacer having a first length and a second spacer having a second length, wherein the packer cup assembly comprises a third length, wherein the step of providing the packer cup assembly at the position on the gauge section by installing said at least one spacer and the packer cup assembly on the gauge section comprises installing the first spacer, the second spacer, and the packer cup assembly on the gauge section, and wherein the sum of the first length, the second length, and the third length equals the total length.

13. The method of claim 10, further comprising providing an additional packer cup assembly at an additional position on the gauge section, wherein the additional packer cup assembly and the packer cup assembly have differing diameters adapted for engaging a tapered region of the tubular member.

14. A system for adapting a fill up and circulation tool for use at a worksite, the system comprising:

an elongate body having a first end adapted for engaging a drive mechanism, a second end adapted for insertion into a tubular member, and a gauge section having a diameter less than the diameter of the first end and the diameter of the second end a gauge section;

a packer cup assembly adapted for engagement with the gauge section; and a plurality of spacers adapted for engagement with the gauge section, wherein the packer cup is adjustably positionable at a plurality of locations on the gauge section by:

providing the packer cup assembly at an end of the gauge section and providing at least one of the spacers adjacent to the packer cup assembly such that the packer cup assembly and said at least one of the spacers occupy substantially all of the gauge section; or providing at least a first of the spacers at the end of the gauge section, providing the packer cup assembly adjacent to said at least a first of the spacers such that a first end of the packer cup is adjacent to said at least a first of the spacers, and providing at least a second of the spacers adjacent to a second end of the packer cup assembly, such that the packer cup assembly, said at least a first of the spacers, and said at least a second of the spacers occupy substantially all of the gauge section.

15. The system of claim 14, wherein the plurality of spacers comprise a first spacer having a first length, a second spacer having a second length greater than the first length, and a third spacer having a third length greater than the second length.

16. The system of claim 15, wherein the packer cup assembly comprises a packer length, wherein the gauge section comprises a total length, wherein the packer cup assembly is positioned at a first end of the gauge section and the third spacer is positioned at a second end of the gauge section, and wherein the sum of the packer length and the third length equals the total length.

17. The system of claim 15, wherein the packer cup assembly comprises a packer length, wherein the gauge section comprises a total length, wherein the first spacer is positioned at a first end of the gauge section, wherein the second spacer is positioned at a second end of the gauge section, wherein the packer cup assembly is positioned between the first spacer and the second spacer on the gauge section, and wherein the sum of the packer length, the first length, and the second length equals the total length.

18. The system of claim 14, further comprising an additional packer cup assembly adjustably engageable with the gauge section, wherein the additional packer cup assembly and the packer cup assembly have differing diameters adapted for engaging a tapered region of the tubular member.

19. The system of claim 14, wherein the elongate body comprises a one-piece member, and wherein the packer cup assembly and at least one of said spacers are adjustably associated with the one-piece member for enabling positioning of the packer cup assembly without use of specialized tools or separation of the elongate body.

* * * * *